US006671983B2

(12) United States Patent
Quenzi et al.

(10) Patent No.: US 6,671,983 B2
(45) Date of Patent: Jan. 6, 2004

(54) SNOW GROOMER ASSEMBLY

(75) Inventors: Philip J. Quenzi, Atlantic Mine, MI (US); Russell G. Alger, Hancock, MI (US)

(73) Assignee: Board of Control of Michigan Technological University, Houghton, MI (US)

( * ) Notice: Subject to any disclaimer, the term of this patent is extended or adjusted under 35 U.S.C. 154(b) by 232 days.

(21) Appl. No.: 10/003,664

(22) Filed: Oct. 23, 2001

(65) Prior Publication Data

US 2002/0035797 A1 Mar. 28, 2002

Related U.S. Application Data

(63) Continuation-in-part of application No. 09/134,265, filed on Aug. 14, 1998, now abandoned.

(51) Int. Cl.[7] ..... E01H 4/02
(52) U.S. Cl. ..... 37/222
(58) Field of Search ..... 37/219, 220, 221, 37/222, 223, 224, 225, 465, 196; 172/21

(56) References Cited

U.S. PATENT DOCUMENTS

| | | | | |
|---|---|---|---|---|
| 1,111,628 A | | 10/1914 | Wettervik | |
| 2,223,213 A | | 11/1940 | Kersten | |
| 2,657,619 A | | 11/1953 | Gilreath | |
| 2,786,283 A | | 3/1957 | Bradley | |
| 2,925,870 A | * | 2/1960 | Michelsen et al. | 172/146 |
| 3,652,106 A | | 3/1972 | Waterman | |
| 3,794,122 A | * | 2/1974 | Rohrer | 172/66 |
| 3,867,992 A | * | 2/1975 | Waterman | 180/14.4 |
| 4,021,942 A | * | 5/1977 | Purdy | 37/222 |
| 4,056,328 A | * | 11/1977 | Maxey | 404/96 |
| 4,348,825 A | | 9/1982 | Bachler | |
| 4,437,245 A | | 3/1984 | Nigmela | |
| 4,523,398 A | | 6/1985 | Scheibel et al. | |
| 5,412,884 A | * | 5/1995 | Staples et al. | 37/342 |
| 5,464,066 A | * | 11/1995 | Doucet | 172/1 |
| 5,586,603 A | | 12/1996 | Mattis | |
| 5,611,291 A | | 3/1997 | Pogue | |

* cited by examiner

*Primary Examiner*—Thomas B. Will
*Assistant Examiner*—Kristine Florio
(74) *Attorney, Agent, or Firm*—Michael Best & Friedrich LLP

(57) ABSTRACT

A snow groomer includes a movable platform, a prime mover mounted to the platform and a grooming drum rotatably driven by the prime mover for rotation in a direction opposite the traveling direction of the snow groomer. The grooming drum includes axially spaced apart and radially protruding ribs that extend circumferentially around the drum. The ribs include circumferentially spaced apart apertures and the apertures of each rib are aligned with the apertures of the other ribs. Elongated cutting teeth extend through the apertures of the ribs and have a cross-sectional area that is smaller than the apertures such that the cutting teeth are free to vibrate within the apertures as the drum rotates, thereby enhancing the pulverization of chunks of snow and ice.

24 Claims, 5 Drawing Sheets

12
10
42
80
86
92
88
16
14
70
76
74
100
72
84
82
94
84
90
20
30

40
41
37
62
38
14
66
36
30
32

14
18
37
41
30
32
33
34
35
36
52
38
42
43
44
50
54
60
19
102
46
45
22
24
26
28
16
20
88
80
100
90

SNOW GROOMER ASSEMBLY

RELATED APPLICATIONS

The present application is a continuation-in-part of U.S. patent application Ser. No. 09/134,265, filed Aug. 14, 1998 now abandoned.

BACKGROUND OF THE INVENTION

1. Field of the Invention

The present invention relates generally to groomers for snow and, more particularly, to a snow groomer assembly for grooming snow.

2. Description of the Related Art

It is known to groom snowmobile trails by the use of drags pulled behind a tractor. These drags cut off the tops of the bumps or moguls and fill in the valleys. The resulting trail looks very smooth. However, the snow filling the valleys is made up of relatively large chunks with minimal compaction and therefore does not bond together to form a hard durable surface. The tops of the shaved off moguls are quite hard. As a result, as snowmobiles traverse the newly groomed trail, the loose snow in the valleys is compacted and displaced and the trail becomes bumpy in a short time.

It is also known to use a tiller to groom snow on a nordic ski trail and alpine ski slope. The tiller has a rotating cylinder that cuts up a surface of a snow pack on the trail or slope. Although the above tiller has worked well, it suffers from the disadvantage that the tiller works on the snow pack as a whole, thereby impacting only a minimal number of individual particles. Snow on heavily used alpine ski areas often turns into chunks of ice (called death cookies). It is desirable to turn those ice chunks back into snow without compaction to provide a good ski surface. Current equipment such as groomers or tillers will not do this. Thus, there is a need in the art to provide a snow groomer that acts on the individual particles of a snow pack, thereby changing the actual structure or make-up of the snow pack and to then densely compact the particles into a smooth surface.

SUMMARY OF THE INVENTION

It is, therefore, one object of the present invention to provide an improved snow groomer assembly for grooming snow on snowmobile trails and alpine ski hills.

It is another object of the present invention to provide a snow groomer assembly that acts on individual snow particles and changes the structure of a snow pack.

To achieve the foregoing objects, the present invention is a snow groomer assembly. The snow groomer assembly includes a rotor and a plurality of teeth on the rotor extending axially and spaced circumferentially about the rotor to condition a snow pack when contacted.

One advantage of the present invention is that an improved snow groomer assembly is provided. Another advantage of the present invention is that the snow groomer assembly provides increased durability and thus prolongs the smoothness of the trail or slope. Yet another advantage of the present invention is that the snow groomer assembly allows ice to be turned back into snow on alpine slopes and snowmobile trails. Still another advantage of the present invention is that the snow groomer assembly acts on individual snow particles or grains and actually changes the structure of the snow pack.

Other objects, features and advantages of the present invention will be readily appreciated as the same becomes better understood after reading the subsequent description when taken in conjunction with the accompanying drawings.

DESCRIPTION OF THE PREFERRED EMBODIMENTS

Figure 1:
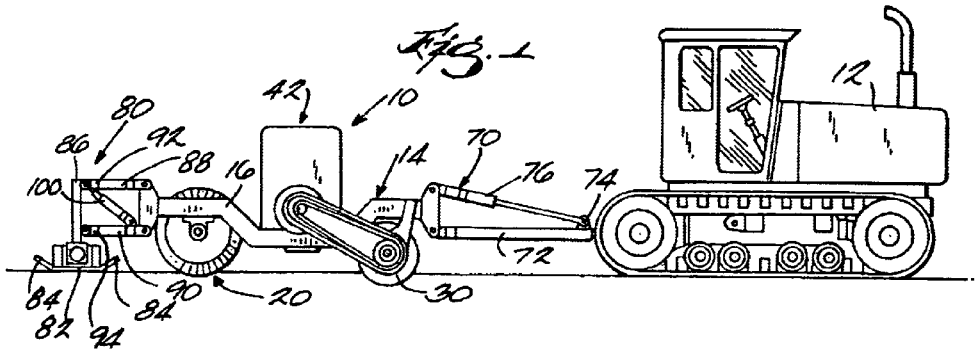
FIG. 1 is an elevational view of a snow groomer assembly, according to the present invention, illustrated in operational relationship with a vehicle.
Figure 4:
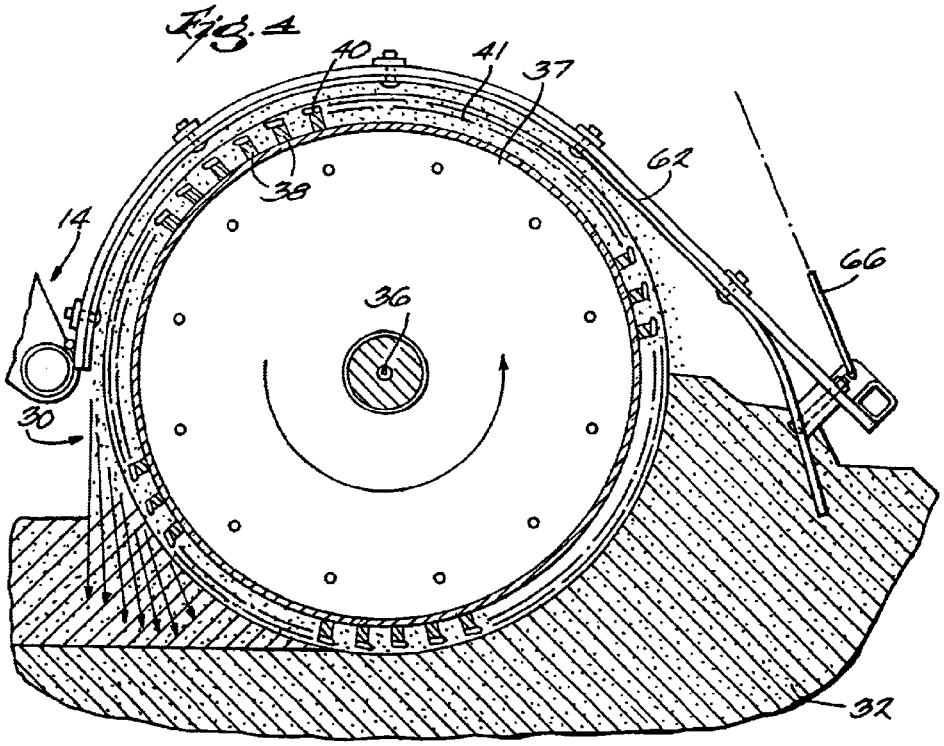
FIG. 4 is a fragmentary elevational view of a portion of the snow groomer assembly of FIG. 1.

Referring to FIG. 1, one embodiment of a snow groomer assembly 10, according to the present invention, is illustrated in operational relationship with a vehicle 12. The vehicle 12 is of a type known as a snow tractor, which is conventional and known in the art. It should be appreciated that the vehicle 12 can either push or pull the snow groomer assembly 10 or the snow groomer assembly 10 could be self-propelled.

Figure 2:
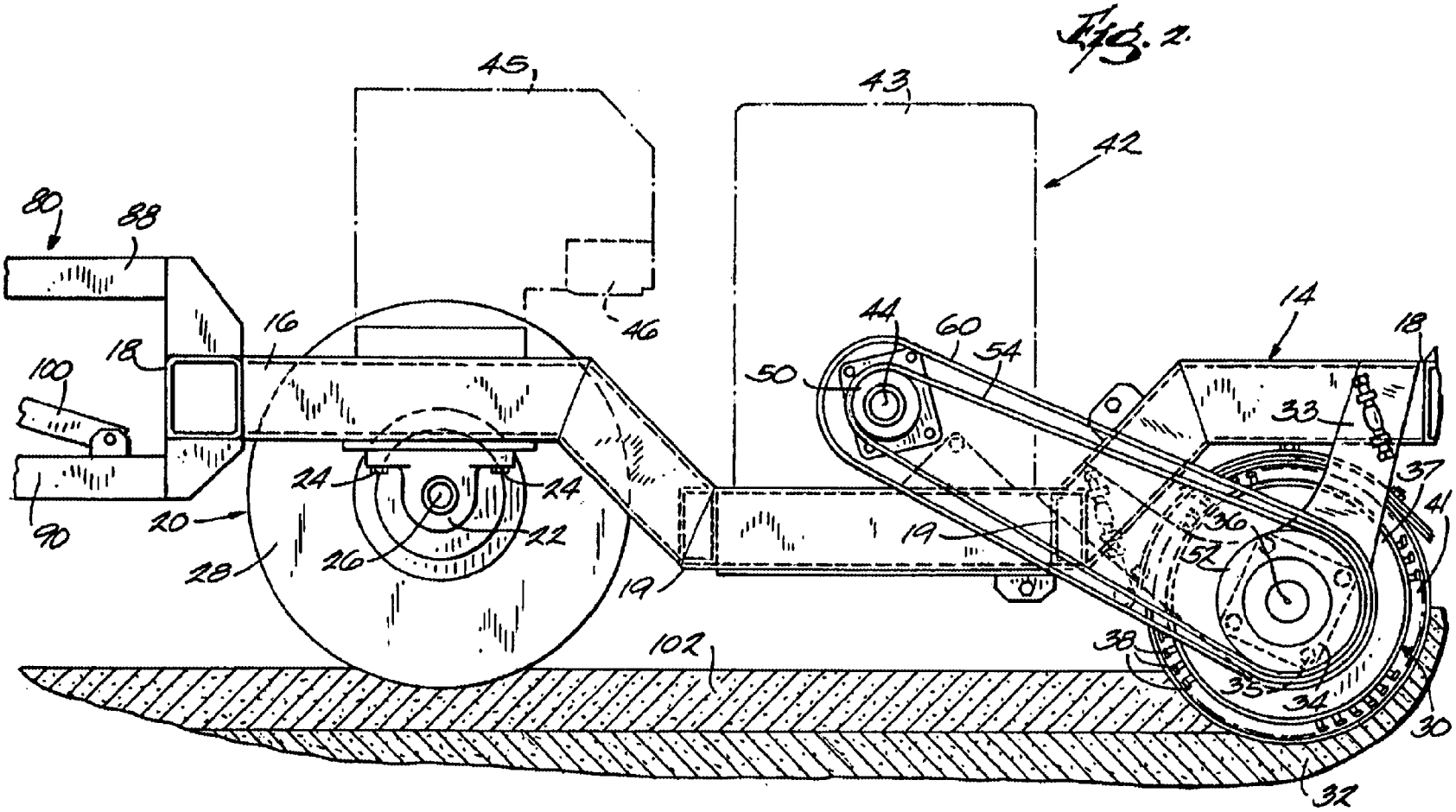
FIG. 2 is an enlarged elevational view of the snow groomer assembly of FIG. 1.
Figure 3:
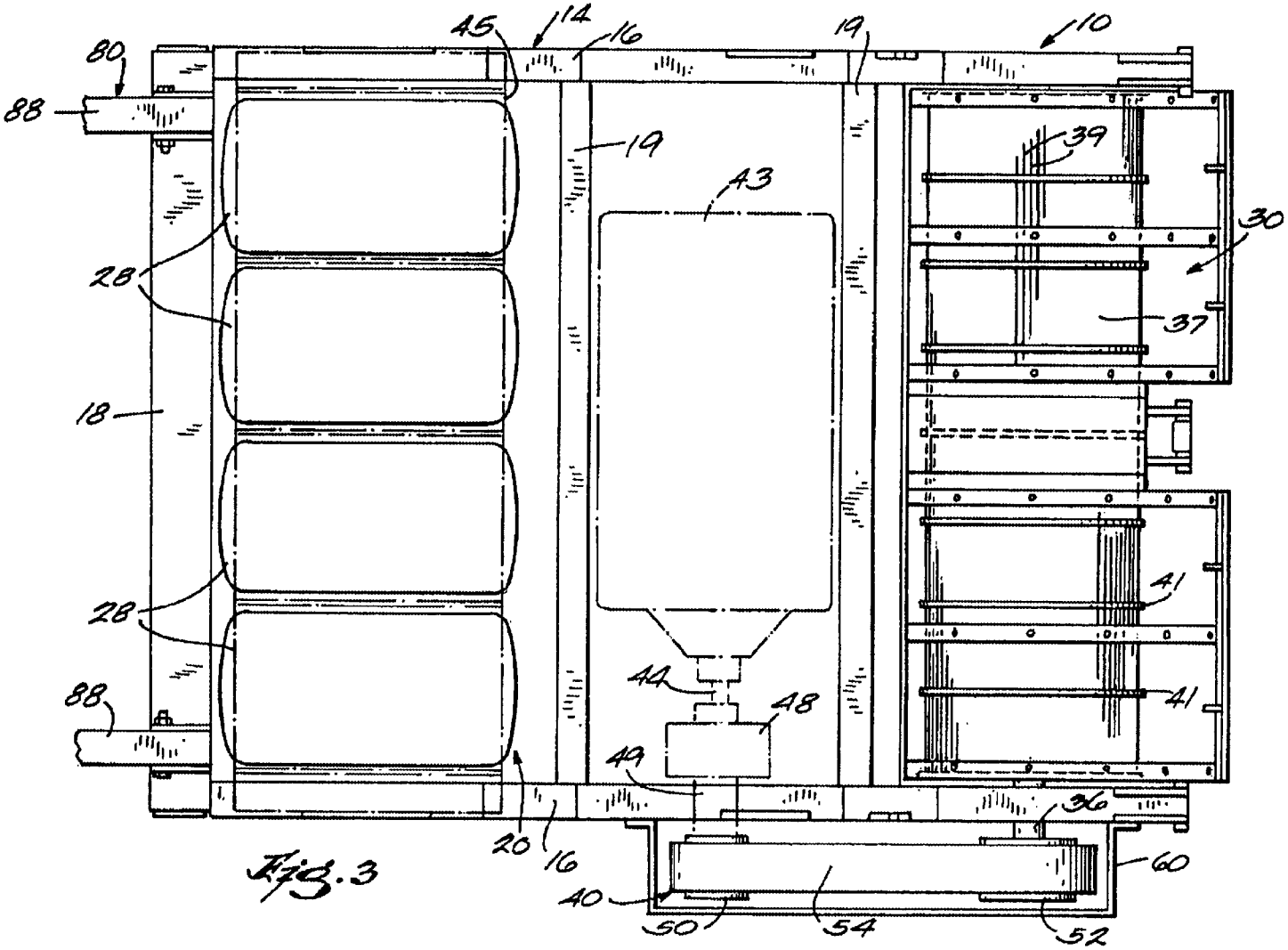
FIG. 3 is a plan view of the snow groomer assembly of FIG. 1.

Referring to FIGS. 1 through 3, the snow groomer assembly 10 includes a frame assembly, generally indicated at 14. The frame assembly 14 includes a pair of side rails 16 extending longitudinally and spaced transversely. The frame assembly 14 also includes an end cross member 18 at both longitudinal ends of the side rails 16 and extending transversely therebetween. The frame assembly 14 includes a plurality of intermediate cross members 19 disposed longitudinally between the end cross members 18 and extending transversely between the side rails 16. The side rails and cross members 18 and 19 are generally rectangular tubular members secured together by suitable means such as welding.

The snow groomer assembly 10 also includes a wheel assembly, generally indicated at 20, operatively connected to the frame assembly 14 to allow the frame assembly 14 to be mobile such that it can be pushed or pulled by the vehicle 12. The wheel assembly 20 includes a bearing block 22 having a bearing therein on each side rail 16 near a rearward end thereof. The bearing block 22 is attached to an underside of the side rail 16 by suitable means such fasteners 24. The wheel assembly 20 also includes an axle or rotatable shaft 26 extending transversely between the side rails 16 and extending into the bearings of the bearing blocks 22 for rotation relative to the frame assembly 14. The wheel assembly 20 includes at least one, preferably a plurality of wheels 28 connected to the axle 26 for rotation therewith. The wheels 28 are of the type having a wheel rim and tire. It should be appreciated that the bearing blocks 22, axle 26 and wheels 28 are conventional and known in the art. It should also be appreciated that tracks could be used instead of the wheels 28.

Referring to FIGS. 1 through 4, the snow groomer assembly 10 includes a rotor assembly, generally indicated at 30, to condition or groom a snow pack 32 on a trail or slope. The rotor assembly 30 is disposed between the side rails 16 near a forward end thereof or opposite the end of the wheel assembly 20. The rotor assembly 30 includes a support member 33 on the left side rail 16. The support member 33 is generally V-shaped and extends downwardly from the left side rail 16. The support member 33 is attached to the left side rail 16 by suitable means such as bolts in slotted holes to permit adjustment longitudinally and laterally of the left end of a rotor 37 to be described. A right side of the rotor 37 is supported by a belt case 60 to be described and is not adjustable. The rotor assembly 30 also includes a bearing block 34 having a bearing therein attached to left support member 33 and belt case 60 by suitable means such as fasteners 35. The rotor assembly 30 includes a rotatable shaft 36 extending transversely between the side rails 16 and extending into the bearings of the bearing blocks 34 for rotation relative to the frame assembly 14. It should be appreciated that the rotor assembly 30 is positioned vertically below the wheel assembly 20 a predetermined distance such as six inches for a six inch cut depth into the snow pack 32. It should also be appreciated that this cut depth is variable by raising or lowering the front of frame assembly 14 by a lift arm 72 and a lift cylinder 76 to be described.

The rotor assembly 30 includes a rotor 37 disposed about the shaft 36. The rotor 37 is a cylindrical tube or drum disposed about the shaft 36 and secured thereto by suitable means such as welding to allow rotation therewith. The rotor assembly 30 includes a plurality of teeth 38 disposed circumferentially about the rotor 37. Preferably, the rotor 37 has approximately forty-eight (48) teeth 38 disposed circumferentially thereabout in a row and a plurality of rows spaced transversely along the rotor 37 to cut, reduce or condition the snow pack 32 when contacted. The teeth 38 are 0.5 inches in circumferential width and have a radial height of 0.75 inches with a bite per tooth of approximately 0.154 inches at 7 mph forward speed. The teeth 38 are formed by bars 39 extending axially and mounted to the rotor 37 by sliding the bars 39 through slots 40 in a plurality of, preferably nine, cutter retainer ribs that are formed by discs 41 extending radially and spaced axially along the rotor 37. The discs 41 are secured to the rotor 37 by suitable means such as welding.

The snow groomer assembly 10 includes a drive assembly, generally indicated at 42, for rotatably driving the rotor assembly 30. The drive assembly 42 includes a prime mover 43 such as an internal combustion engine attached by suitable means such as bracing and fasteners (not shown) to the frame assembly 14. The prime mover 43 has a rotatable shaft 44 extending transversely therefrom. The drive assembly 42 includes a fuel source 45 such as a diesel fuel tank and an electrical source 46 such as batteries attached by suitable means such as bracing and fasteners (not shown) to the frame assembly 14. The fuel source 45 and electrical source 46 are connected by suitable means (not shown) to the prime mover 43. It should be appreciated that the prime mover 43, fuel source 45 and electrical source 46 are conventional and known in the art.

The drive assembly 42 also includes a torsional coupling 48 connecting the shaft 44 and a belt case input shaft 49. An input drive sprocket 50 is keyed to the input shaft 49. An output drive sprocket 52 is keyed to the rotor shaft 36. The drive assembly 42 includes a belt 54 interconnecting the sprockets 50 and 52. The drive assembly 42 rotates the rotor 37 at a predetermined speed such as V2 engine speed or 1100 rpm at rated engine speed. It should be appreciated that the prime mover 43 rotates the shaft 44, torsional coupling 48, sprocket 50 and belt 54, in turn, rotating the sprocket 52, shaft 36, and rotor 37 and teeth 38 of the rotor assembly 30. It should also be appreciated that the drive assembly 42 may have a plurality of sprockets and belts to rotate the rotor assembly 30.

Alternatively, the rotor 37 could be driven hydraulically. In this case, the prime mover 43 drives a hydraulic pump (or pumps) (not shown) which, in turn, are coupled by flexible hydraulic lines (not shown) to a hydraulic motor (or motors) (not shown) which drive the rotor 37. This structure, although less efficient provides the ability to run the rotor 37 in both directions (clockwise and counter clockwise).

The snow groomer assembly 10 also includes a belt case 60 to enclose the sprockets 50 and 52 and belt 54. The belt case 60 is attached to the frame assembly 14 by suitable means such as fasteners (not shown). The snow groomer assembly 10 further includes a cover or fender 62 spaced from the rotor assembly 30. The cover 62 is generally arcuate in shape and extends transversely between the side rails 16. The cover 62 is supported at the rear by pins 64 and at the front by chains or cables 66.

The snow groomer assembly 10 also includes a hitch assembly, generally indicated at 70, pivotally connected to the frame assembly 14 to allow the snow groomer assembly 10 to be towed behind the vehicle 12 and to raise and lower the frame assembly 14. The hitch assembly 70 consists of an A-frame shaped lift arm 72 pivotally connected to the side rails 16 of the frame assembly 14 by suitable means. The hitch assembly 70 includes a support plate 74 secured to the other end of the Jill arm 72 by suitable means such as welding. The hitch assembly 70 includes a hydraulic lift cylinder 76 pinned to the frame assembly 14 and the lift arm 72 for purposes of raising and lowering the frame assembly 14.

The snow groomer assembly 10 includes a packing assembly, generally indicated at 80, at a rearward end thereof for packing the conditioned snow. The packing assembly 80 includes a vibrator pan or plate 82 having upturned flanges 84 and connected to a post member 86. The packing assembly 80 includes a pair of upper and lower support members 88 and 90 extending longitudinally and a pair of upper and lower cross members 92 and 94 extending transversely between the support members 88 and 90 and connected thereto by suitable means such as welding. The support members 88 and 90 and cross members 92 and 94 are tubular and generally rectangular in shape. The support members 88 and 90 are pivotally connected to the post member 80 and the frame assembly 14 by suitable means. The packing assembly 80 also includes two hydraulic cylinders 100 interconnecting the upper and lower support members 88 and 90 and pivotally connected thereto by suitable means to vary the down pressure of the plate 82 and to raise and lower the packing assembly 80. It should be appreciated that the vibrator plate 82 acts as a skid plate and does the final compacting of the newly milled snow.

In operation, the snow groomer assembly 10 is connected to the vehicle 12 via the hitch assembly 70. The prime mover 43 of the drive assembly 42 is started to rotate the rotor 37 of the rotor assembly 30. The vehicle 12 pulls the snow groomer assembly 10 along a snow pack 32 at a predetermined speed such as seven to ten miles per hour as illustrated in FIG. 1. The drive assembly 42 generally counter-rotates the rotor 37 with respect to the traveling direction of the snow groomer 10 as illustrated by the arrow in FIG. 4 (up-milling). As the rotor 37 rotates, the teeth 38 bite into the snow pack 32 and snow is captured in cavities between the teeth 38 and cover 62. At the rear of the rotor 37 where the cover 62 stops, centrifugal force causes the finely milled snow to exit the rotor assembly 30 and forcefully impact the trail surface. The new finely milled snow is then compacted to a high density by the wheels 28 and vibrator pan 82. This finely milled densely compacted snow 102 will consolidate into a very hard and durable snowmobile trail surface very quickly. For operation on alpine ski hills, the compaction would be reduced or eliminated resulting in the transmission of the ice chunks to fine snow ideal for skiing on.

Figure 6:
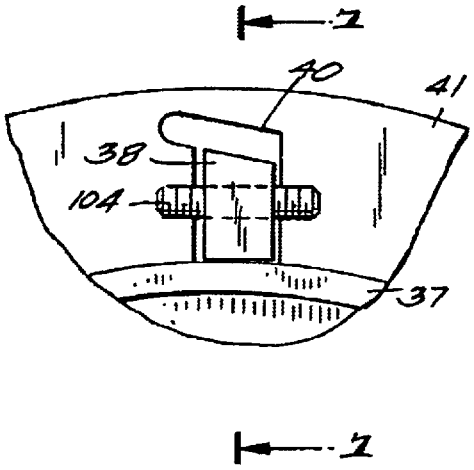
FIG. 6 is an enlarged side view of a portion of the drum assembly.
Figure 7:
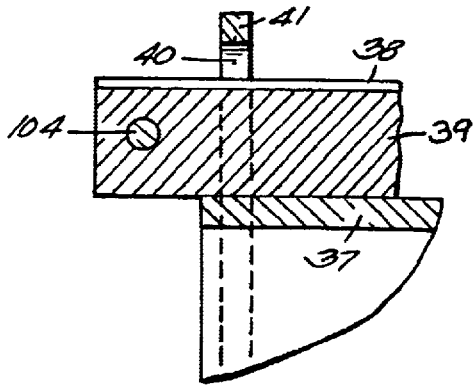
FIG. 7 is a section view taken along line 7—7 of FIG. 6.
Figure 5:
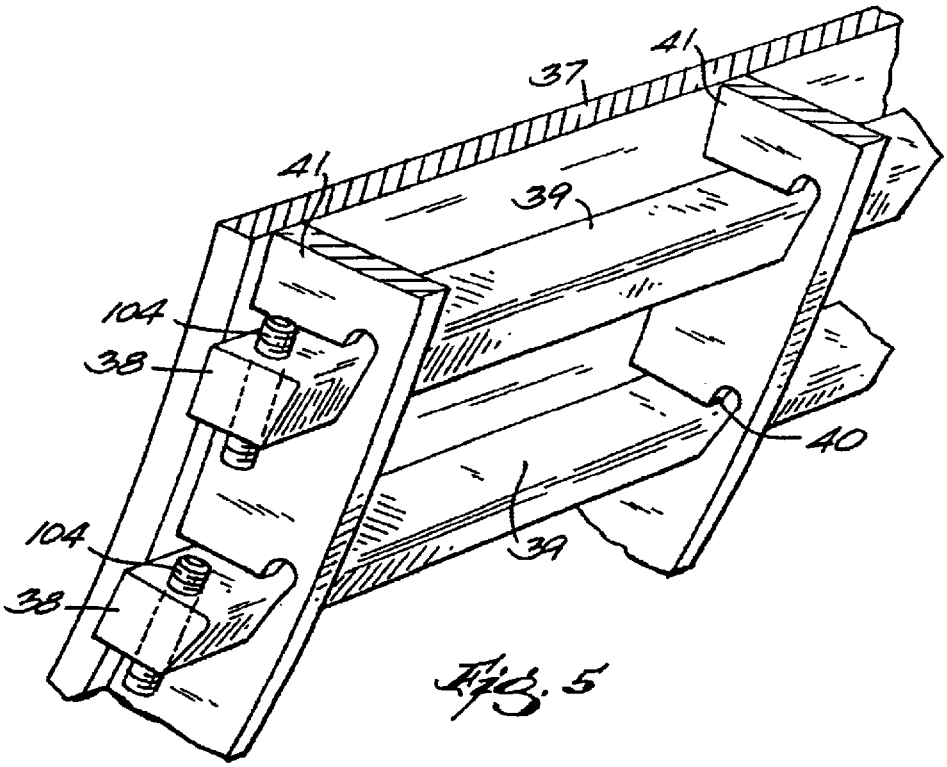
FIG. 5 is an enlarged perspective view of a portion of the groomer drum assembly.

FIGS. 5–7 better illustrate the bars 39 as they are supported within the slots 40 in the ribs or discs 41. Each bar 39 includes a pin, bolt, or other retainer member 104 extending through each of its ends. The retainer members 104 are long enough to prevent the bar 39 from being slid axially out of the slots 40. The retainer members 104 may alternatively be substantially anywhere along the lengths of the bars 39 to limit axial movement of the bars 39 in the slots 40.

The bars 39 are configured to have cross-sectional areas and dimensions that are smaller than the slots 40 in which they are supported. This permits the bars 39 to rattle within the slots 40. The rattling and resultant vibration of the bars 39 facilitates the reduction and pulverization of the hard-packed snow and ice into finer particles that are more suitable for the landscape (e.g. ski hills or snowmobile trails) over which the groomer 10 is traveling. The rattling and vibration of the bars 39 also prevents the build-up of snow and ice between the bars 39 and rotor 37, as well as between individual bars 39.

The illustrated construction includes bars 39 having lengths substantially equal to the longitudinal extent of the rotor 37. The illustrated slots 40 on the discs 41 are aligned with the slots 40 of all other discs 41. Alternatively, some slots 40 may be aligned with some, but not all slots 40 of the other discs 41. In this regard, groups of aligned slots 40 may support shorter bars 39, and the bars 39 may be staggered with respect to each other.

Figure 8:
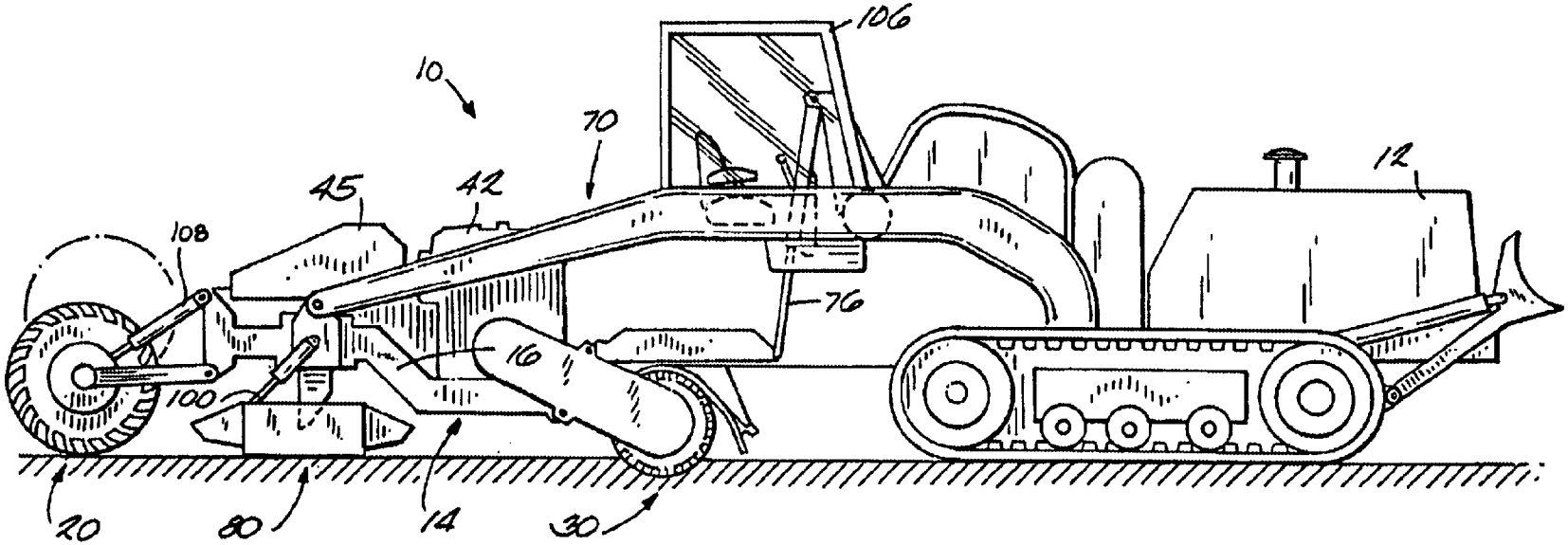
FIG. 8 is an elevational view of an alternative embodiment of the present invention.

FIG. 8 illustrates an alternative embodiment of the invention. In this embodiment the hitch assembly 70 also supports an operator enclosure 106 and is secured to a more centrally located area of the vehicle 12. The lift cylinder 76 is also reoriented to a more vertical position to raise and lower the rotor assembly 30, thereby adjusting the cut depth of the snow groomer 10. The positions of the packing assembly 80 and wheel assembly 20 have also been switched. An actuator 108 is employed to raise and lower the wheel assembly 20. During snow grooming operations, the wheel assembly 20 is moved to a raised position and the snow groomer 10 is supported by packing assembly 80. When an obstacle such as a road or other non-snow-covered surface is approached, the wheel assembly 20 is lowered, thereby raising the rotor assembly 30 and packing assembly 80 to a non-grooming position. When engaged with a snow-covered surface, the packing assembly 80 operates in the same manner as the previous embodiment. The remaining components including the frame assembly 14, prime mover 42, fuel source 45, and rotor assembly 30 operate and interact in substantially the same manner as described for the previous embodiment.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A grooming drum adapted for use with a snow grooming device, said drum comprising:

an elongated cylinder including a central axis, said cylinder supportable by the snow grooming device for rotation about said central axis;

a plurality of axially spaced apart and radially protruding ribs extending circumferentially around said cylinder, said ribs including circumferentially spaced apart apertures, the apertures of each rib being substantially aligned with the apertures of at least one other rib; and a plurality of elongated cutting teeth, each cutting tooth extending through aligned apertures of said ribs, said cutting teeth including a cross-sectional area, wherein said apertures are larger than said cross-sectional area to permit said cutting teeth to move with respect to said ribs as said drum rotates.

2. The grooming drum of claim 1, wherein the snow grooming device is adapted to carry said drum in a direction of travel, and wherein said drum counter-rotates with respect to the direction of travel to agitate and groom snow.

3. The grooming drum of claim 1, wherein said apertures of each rib are substantially axially aligned with the apertures of every other rib.

4. The grooming drum of claim 1, wherein said elongated cutting teeth extend from one end of said drum to an opposite end of said drum along an axis that is substantially parallel to said central axis.

5. The grooming drum of claim 1, wherein said cutting teeth include through bores in opposite distal ends, said drum further comprising pin members extending through said bores to retain said cutting teeth in said apertures.

6. The grooming drum of claim 1, wherein said cutting teeth vibrate within said apertures as said drum rotates, said cutting teeth pulverizing compacted snow and ice into fine particles as said teeth vibrate.

7. The grooming drum of claim 1, wherein during rotation of said drum, said elongated cutting teeth rattle within said apertures due to a clearance between said apertures and said cutting teeth owing to the apertures being larger than said cross-sectional area of said cutting teeth, and wherein said rattling causes compacted snow carried by said drum to be reduced to relatively fine particles.

8. The grooming drum of claim 1, wherein said cutting teeth are slidable in a direction substantially parallel to said central axis.

9. A snow groomer for use on a snow-covered landscape, said snow groomer comprising:

a movable platform adapted to move in a forward direction;

a prime mover mounted to said platform;

a grooming drum rotatably mounted to said platform; and a power transmission assembly operatively interconnecting said prime mover with said grooming drum, wherein in response to operation of said prime mover, said drum counter-rotates with respect to the forward direction to agitate and groom snow on the snow-covered landscape.

10. The snow groomer of claim 9, wherein said movable platform is towable by a self-propelled vehicle.

11. The snow groomer of claim 9, wherein said prime mover includes a compression-ignition engine.

12. The snow groomer of claim 9, wherein said grooming drum includes a plurality of axially spaced apart and radially protruding ribs extending circumferentially around said drum.

13. The snow groomer of claim 12, wherein said drum includes a plurality of elongated cutting teeth, each cutting tooth extending through apertures in said ribs.

14. The snow groomer of claim 13, wherein said cutting teeth include a cross-sectional area, and wherein said apertures are larger than said cross-sectional area to permit said cutting teeth to move with respect to said ribs as said grooming drum rotates.

15. The snow groomer of claim 9, further comprising a packing assembly, said packing assembly positioned rearwardly of said drum with respect to the forward direction and operable to pack the agitated and groomed snow.

16. The snow groomer of claim 9, further comprising a snow deflecting cover spaced from and partially surrounding said grooming drum to guide snow around said drum.

17. The snow groomer of claim 9, wherein said prime mover and said grooming drum operate independently of movement of said platform in the forward direction.

18. A snow groomer for use on a snow-covered landscape, said snow groomer comprising:

a movable platform adapted to move in a forward direction;

a prime mover mounted to said platform;

a grooming drum rotatably mounted to said platform, said grooming drum including a central axis, a plurality of axially spaced apart and radially protruding ribs extending circumferentially around said drum, said ribs including circumferentially spaced apart apertures, the apertures of each rib being substantially aligned with the apertures of at least one other rib, and a plurality of elongated cutting teeth, each cutting tooth extending through axially aligned apertures of said ribs, said cutting teeth including a cross-sectional area; and a power transmission assembly operatively interconnecting said prime mover with said grooming drum, wherein in response to operation of said prime mover, said drum counter-rotates with respect to the forward direction and wherein said apertures are larger than said cross-sectional area to permit said cutting teeth to move with respect to said ribs as said drum rotates to agitate and groom snow on the snow-covered landscape.

19. The snow groomer of claim 18, further comprising a packing assembly, said packing assembly positioned rearwardly of said drum with respect to the forward direction and operable to pack the agitated and groomed snow.

20. The snow groomer of claim 18, wherein said prime mover and said grooming drum operate independently of movement of said platform in the forward direction.

21. The snow groomer of claim 18, wherein said apertures of each rib are substantially axially aligned with the apertures of every other rib.

22. The snow groomer of claim 18, wherein said elongated cutting teeth extend from one end of said drum to an opposite end of said drum along an axis that is substantially parallel to said central axis.

23. The snow groomer of claim 18, wherein said cutting teeth rattle within said apertures during rotation of said drum to facilitate the agitation.

24. The snow groomer of claim 18, wherein said cutting teeth include a longitudinal extent and at least one stop member extending transverse to said longitudinal extent, said stop member being too large to pass through at least one of said apertures when said stop member is in said transverse orientation.

* * * * *